US006905044B1

(12) United States Patent
Russo et al.

(10) Patent No.: US 6,905,044 B1
(45) Date of Patent: Jun. 14, 2005

(54) SPLASH INHIBITING BEVERAGE CONTAINER LID

(75) Inventors: Robert Russo, 1926 Clover Ct., Pleasanton, CA (US) 94588; Robert Kichinski, Livermore, CA (US)

(73) Assignee: Robert Russo, Pleasanton, CA (US)

( * ) Notice: Subject to any disclaimer, the term of this patent is extended or adjusted under 35 U.S.C. 154(b) by 17 days.

(21) Appl. No.: 10/043,908

(22) Filed: Jan. 11, 2002

(51) Int. Cl.[7] ..... A47G 19/22
(52) U.S. Cl. ..... 220/719; 220/713; 220/711; 229/404; 229/906.1
(58) Field of Search ..... 220/713, 714, 220/716, 719, 731, 715, 717, 718; 229/404, 229/906.1; D9/434, 447, 454

(56) References Cited

U.S. PATENT DOCUMENTS

| | | | | |
|---|---|---|---|---|
| 2,414,697 A | | 1/1947 | Pattersson | |
| 2,534,614 A | | 12/1950 | Michael | |
| 2,765,639 A | * | 10/1956 | Bryant | 220/713 |
| 3,850,337 A | * | 11/1974 | Parks | 220/792 |
| 3,920,146 A | | 11/1975 | Baller | |
| 4,394,928 A | | 7/1983 | Philip | |
| 4,503,992 A | | 3/1985 | Sitko et al. | |
| 4,589,569 A | | 5/1986 | Clements | |
| 4,619,372 A | | 10/1986 | McFarland | |
| 4,756,440 A | | 7/1988 | Gartner | |
| 4,869,390 A | | 9/1989 | Kennedy | |
| 4,938,379 A | | 7/1990 | Kellner | |
| 4,953,743 A | | 9/1990 | Dart et al. | |
| 4,978,024 A | | 12/1990 | Newman et al. | |
| 4,986,437 A | | 1/1991 | Farmer | |
| 5,076,425 A | * | 12/1991 | Plone | 206/220 |
| 5,253,781 A | | 10/1993 | Van Melle et al. | |
| 5,538,156 A | | 7/1996 | Proshan | |
| 5,538,157 A | | 7/1996 | Proshan | |
| 5,996,837 A | | 12/1999 | Freek et al. | |
| 6,079,588 A | * | 6/2000 | Khafizov | 220/711 |

(Continued)

FOREIGN PATENT DOCUMENTS

GB 2 205 309 A 12/1988

(Continued)

OTHER PUBLICATIONS

U.S. Appl. No. 10/213,571, Russo et al.

(Continued)

*Primary Examiner*—Stephen K. Cronin
*Assistant Examiner*—James N Smalley
(74) *Attorney, Agent, or Firm*—DLA Piper Rudnick Gray Cary US LLP

(57) ABSTRACT

A disposable beverage container lid that includes a top wall with a drinking opening formed therein, an annular sidewall downwardly depending from the periphery of the top wall for engaging with the rim of a beverage container, a regulator valve formed directly underneath the drinking opening, and wave-breaker and periphery inhibitor recesses formed in the top wall, to allow the user to drink from the cup without removing the lid while greatly minimizing accidental splashing of the liquid from the cup. The regulator valve includes side and bottom walls with apertures formed therein. The wave-breaker recess has a sidewall portion that reflects waves of liquid from the regulator valve, and another sidewall portion that defines a channel with the annular sidewall in which the regulator valve is disposed. The inhibitor recesses extend down into the channel to prevent waves of liquid traveling therethrough.

24 Claims, 5 Drawing Sheets

U.S. PATENT DOCUMENTS 6,220,476 B1 4/2001 Waller
6,296,141 B1 10/2001 Lukacevic
6,305,571 B1 10/2001 Chu
6,311,863 B1 11/2001 Fleming
6,325,236 B1 * 12/2001 Wong ..... 220/713
6,431,390 B1 * 8/2002 Waller ..... 220/713
6,464,099 B1 10/2002 Portman
6,488,173 B2 12/2002 Milan
6,523,712 B1 2/2003 McGushion
6,533,139 B2 * 3/2003 Lukacevic ..... 220/719

FOREIGN PATENT DOCUMENTS

GB 2205309 A * 12/1988 ..... B65D 47/06
GB 2 311 059 9/1997

OTHER PUBLICATIONS

U.S. Appl. No. 10/317,542, Russo et al.

* cited by examiner

SPLASH INHIBITING BEVERAGE CONTAINER LID

FIELD OF THE INVENTION

The present invention relates to a lid for beverage cups, and more particularly to a lid that enables drinking from a cup without removal of the lid while minimizing accidental splashing or spillage of the liquid from the cup.

BACKGROUND OF THE INVENTION

It is well known to apply disposable lids to drinking cups for carry out sales of beverages, such as coffee. Such lids keep the liquid drink in the cup and prevent heat loss out to the surrounding environment. Many commonly used lids have a small drinking hole formed in the top surface so the user can drink from the cup without removing the lid. For example, U.S. Pat. No. 4,589,569 discloses a lid having a hole formed in its top wall, along with a recess formed in the top wall to accommodate the upper lip of the user. The hole is made relatively small to inhibit accidental splashing or spilling of the liquid through the drinking opening.

Conventional lids with drinking holes have to strike a balance between spillage and drinking flow. As the hole is made smaller, the amount of spillage prevented by the lid increases, but the amount of liquid flow through the hole as the user takes a drink decreases. Thus, by reducing the size of the hole, spillage is reduced at the expense of drinking flow. If the hole is too small, a comfortable amount of drinking flow cannot be achieved. If the hole is made larger to achieve better drinking flow, more liquid can accidentally spill or splash out through the enlarged hole. Prior art lid designs typically include longer side walls so that the upper wall of the lid is well above the top rim of the cup. However, liquid still spills out through the drinking hole.

There are three basic types of liquid spillage from lidded cups: vertical, horizontal and swirling. Vertical spillage can be caused by the cup being vertically slammed too hard on a rigid surface. The liquid in the cup experiences negative gravity acceleration and shoots vertically up to the lid. Any liquid aligned with the drinking hole shoots out of the cup through the hole. Horizontal spillage occurs when the cup is horizontally displaced. The horizontal motion causes a wave of liquid to ride up the side of the cup, along the upper wall of the lid, and out the drinking hole. Swirling spillage occurs when arcing translational movement of the cup causes a wave of fluid to ride up the side of the cup and along the circumference of the cup and lid. When the wave reaches the drinking hole, liquid splashes out from the cup through the hole.

Because of the trade off between spillage prevention and drinking flow, prior art lid designs simply cannot provide adequate spillage prevention, while still providing adequate drinking flow when the user tips the cup for a drink. Raising the top wall of the lid well above the rim of the cup does little to abate the vertical, horizontal and swirling waves of liquid that are responsible for most accidental spillage. There is a need for a lid design that improves spillage protection without comprising the desired drinking flow rate through the lid.

SUMMARY OF THE INVENTION

The present invention solves the aforementioned problems by providing a drinking cup lid that inhibits inadvertent spillage from the cup while still providing good drinking flow when the cup is tilted for a drink.

The lid of the present invention, for covering a drinking cup containing a liquid, includes a top wall having a generally circular periphery, an annular sidewall downwardly depending from the top wall periphery, the lid including a drinking opening formed adjacent to the periphery, and a regulator valve formed under the drinking opening. The regulator valve includes a first sidewall structure downwardly depending from the lid adjacent the drinking opening and terminating in a first bottom wall, and a plurality of apertures formed in at least one of the first sidewall structure and the first bottom wall, wherein any of the plurality of apertures formed in the first sidewall structure are positioned in an opposing manner.

In another aspect of the present invention, the lid includes a top wall having a generally circular periphery, an annular sidewall downwardly depending from the top wall periphery, the lid including a drinking opening formed adjacent to the periphery, and a wave-breaker recess formed in the top wall having a sidewall that extends downwardly. The wave-breaker recess sidewall includes a first portion facing toward the drinking opening and a second portion facing away from the drinking opening. The recess sidewall second portion is non-linear for reflecting waves of the liquid away from the drinking opening.

In yet another aspect of the present invention, the lid includes a top wall having a generally circular periphery, an annular sidewall downwardly depending from the top wall periphery, the lid including a drinking opening formed adjacent to the periphery, and a regulator valve formed under the drinking opening. The regulator valve includes a sidewall structure downwardly depending from the lid adjacent the drinking opening, and a plurality of apertures formed in the sidewall structure and positioned thereon in an opposing manner.

In still yet another aspect of the present invention, the lid includes a top wall having a generally circular periphery, an annular sidewall downwardly depending from the top wall periphery, a drinking opening formed in the top wall adjacent to the periphery, a regulator valve formed under the drinking opening, and a wave-breaker recess formed in the top wall having a sidewall that extends downwardly. The regulator valve includes a first sidewall structure downwardly depending from the top wall adjacent the drinking opening and terminating in a first bottom wall, a second opening formed in the first bottom wall, a second sidewall structure downwardly depending from the first bottom wall adjacent to the second opening and terminating in a second bottom wall, a plurality of apertures formed in the first bottom wall, and at least one aperture formed in the second bottom wall. The wave-breaker recess sidewall includes a first portion facing toward the regulator valve and a second portion facing away from the regulator valve. The recess sidewall second portion has one of a concave and a convex shape for reflecting waves of the liquid away from the regulator valve.

Other objects and features of the present invention will become apparent by a review of the specification, claims and appended figures.

DETAILED DESCRIPTION OF THE PREFERRED EMBODIMENTS

Figure 1:
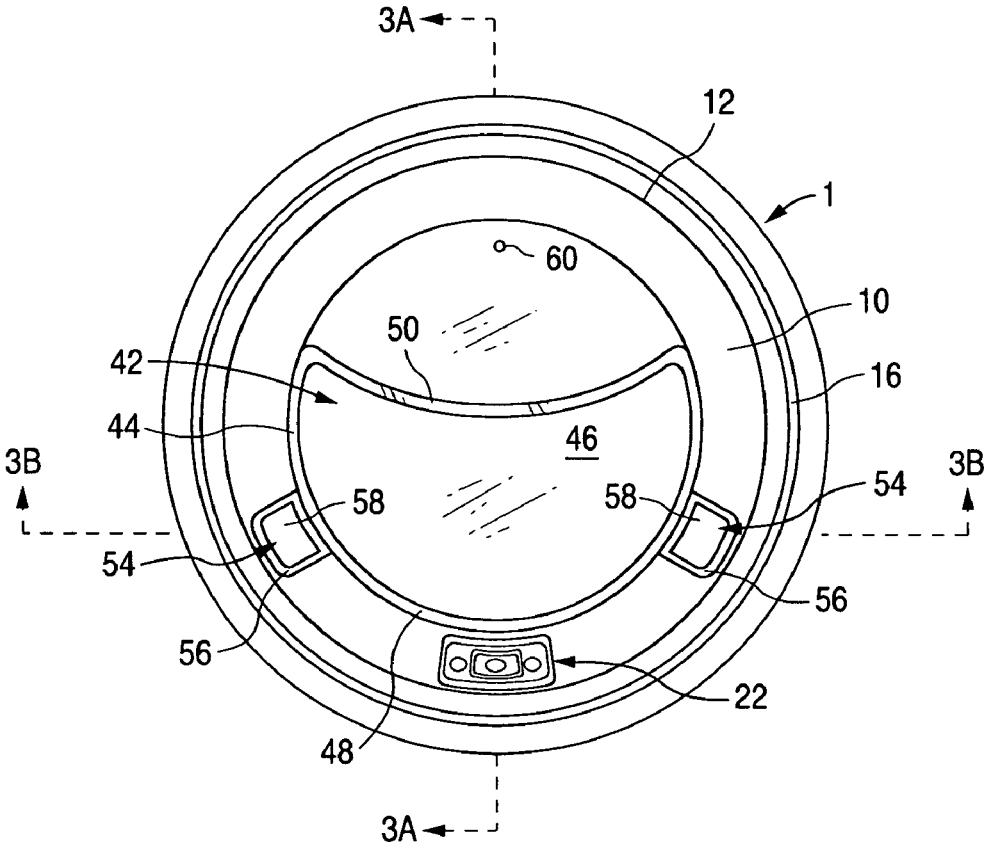
FIG. 1 is a top view of the beverage container lid of the present invention.
Figure 2:
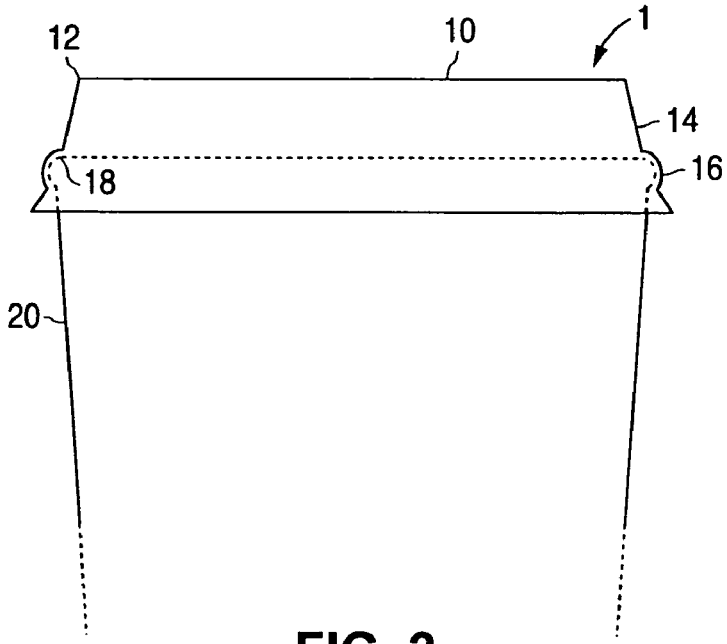
FIG. 2 is a side view of the beverage container lid of the present invention mounted on the rim of a beverage container.

The present invention is a disposable beverage container lid 1 as shown in FIGS. 1 and 2. The lid 1 mounts to the rim of a beverage container (i.e. a beverage cup) and allows the user to drink from the cup without removing the lid while greatly minimizing accidental spillage of the liquid from the cup.

The beverage container lid 1 of the present invention includes a top wall 10 with a generally circular periphery 12, and an annular sidewall 14 depending from the periphery 12. The sidewall 14 includes an annular recess 16 formed therein for receiving the upper rim 18 of a cup 20. While the lid 1 of the present invention can be used with any shape and style cup, it is particularly suitable when used with disposable carry-out style paper or Styrofoam cups having a generally circular upper rim 18. Annular recess 16 has a shape and size to engage with the cup rim 18 in a liquid tight manner to secure the lid 1 to the cup 20. For example, for cups with a rounded bead formed on the upper cup rim 18, the annular recess 16 has a rounded cross-section to tightly receive the rounded bead.

Figure 3A:
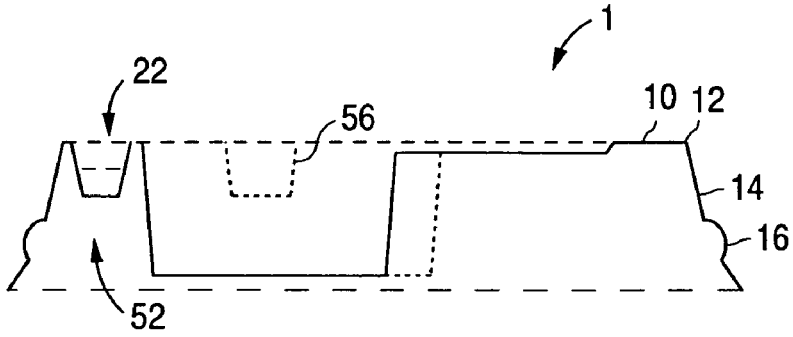
FIG. 3A is a side cross-sectional view of the beverage container lid of the present invention, taken along the lines 3A—3A of FIG. 1.
Figure 4:
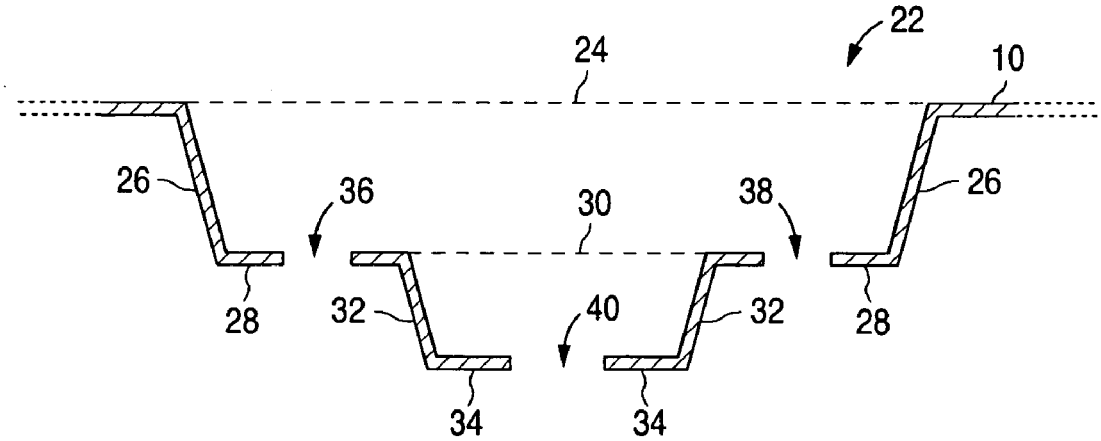
FIG. 4 is a cross-sectional view of the regulator valve of the present invention.

A regulator valve 22 is formed under the top wall 10 adjacent the periphery 12, as best shown in FIGS. 1, 3A, and 4. The regulator valve 22 is disposed directly under a drinking (first) opening 24 formed in the top wall 10, and includes a first sidewall 26 depending from the top wall adjacent to the drinking opening 24 and terminating in a first bottom wall 28. A second opening 30 is formed in the first bottom wall 28, with a second sidewall 32 depending from the first bottom wall 28 adjacent to the second opening 30 and terminating in a second bottom wall 34. First and second apertures 36/38 are formed in the first bottom wall 28 (preferably one on either side of second opening 30). A third aperture 40 is formed in the second bottom wall 34. The user drinks from the cup by placing his/her lips over the drinking opening 24, and tilting the cup until liquid in the cup flows through the apertures 36/38/40 and out drinking opening 24.

Figure 3B:
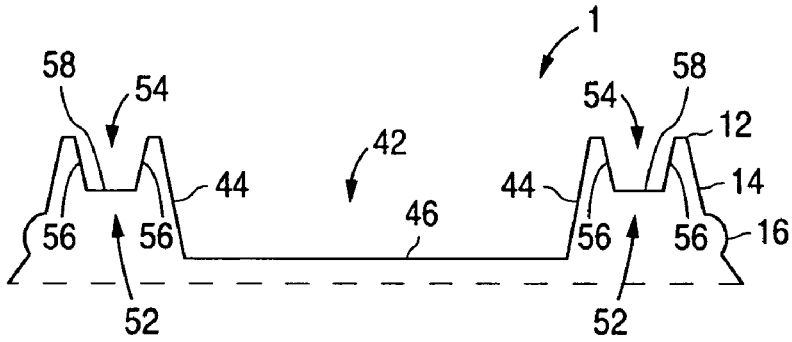
FIG. 3B is a side cross-sectional view of the beverage container lid of the present invention, taken along the lines 3B—3B of FIG. 1.

A wave-breaker recess 42 is formed in the top wall 10 as best shown in FIGS. 1, 3A and 3B, and includes a shaped sidewall 44 extending downwardly and terminating in a wave-breaker bottom wall 46. The shaped sidewall 44 includes an arcuate shaped first portion 48 and a non-linear second portion 50. First portion 48 faces but is separated from (and is concentric with) a portion of annular sidewall 14, forming a channel 52 therebetween. The regulator valve 22 is disposed in channel 52. The non-linear second portion 50 faces away from regulator valve 22 and preferably has a concave shape. In the preferred embodiment, the wave-breaker bottom wall 46 extends further below the top wall 10 than does regulator valve 22.

Periphery inhibitor recesses 54 are formed in the top wall 10, adjacent to the periphery 12, with sidewalls 56 extending down and terminating in bottom walls 58, as best shown in FIGS. 1 and 3B. Preferably, there are two periphery inhibitor recesses 54 that protrude down and into channel 52, one on either side of the regulator valve 22. A very small vent hole 60 is preferably formed in top wall 10 away from regulator valve 22, to prevent a vacuum from forming in the cup as the user drinks.

The above described beverage container lid 1 provides a desired drinking flow through the regulator valve 22 when the beverage cup 20 is tilted by the user for drinking, but minimizes spillage out of the cup 20 when waves are created inside the cup by vertical, horizontal or swirling motions. The regulator valve 22, the wave-breaker recess 42 and the periphery inhibitor recesses 54 help minimize spillage in the following manner. The regulator valve 22 provides a plurality of smaller apertures 36/38/40 through which the liquid flows for drinking that are all disposed below the top wall 10 of the lid 1, instead of just a single larger aperture formed in the lid top wall. Preferably, all of the apertures 36/38/40 are each smaller than drinking opening 24. Together, the smaller apertures 36/38/40 provide good drinking flow when the cup is tilted, yet individually provide smaller targets for the liquid to splash through. Further, a wave of liquid incident on regulator valve 22 is typically aligned with as few as one of the small apertures 36/38/40, thus reducing the amount of liquid from the wave that can escape through the lid. In fact, a wave riding up the cup wall and reaching the periphery 12 adjacent the valve 22 may not be directly aligned with any of the apertures. Moreover, should liquid splash through one or more of the apertures 36/38/40, the liquid would still have to find its way up and out of the drinking opening 24 (i.e. the first and second sidewalls 26/32 would further dampen splashed liquid). Liquid that does not reach the drinking opening 24 would drain back into the cup via the apertures 36/38/40.

Wave-breaker recess 42 reduces splashing by defining the narrow channel 52 in which the regulator valve 22 is disposed. Waves of liquid headed toward the regulator valve 22 will be significantly dampened or blocked by the first portion 48 of the wave-breaker recess sidewall 44 before reaching the regulator valve 22, which is protected inside the channel 52. Moreover, the non-linear (concave) shaped second portion 50 of wave-breaker recess 42 acts as a reflector wall for reflecting waves of liquid traveling along the top wall 10. The non-linear (concave) shape helps dissipate the wave's energy and prevents it from reaching the regulator valve 22.

Periphery inhibitor recesses 54 block waves of liquid trying to travel along the periphery of lid 1 (e.g. down channel 52). With one periphery inhibitor disposed on each side of the regulator valve 22, any such liquid waves would be blocked or dissipated before reaching the regulator valve 22. Periphery inhibitor recesses 54 can be formed anywhere along the periphery 12 of lid 1. For spillage prevention, periphery inhibitor recesses 54 should ideally be disposed as close as possible to the regulator valve 22 along periphery 12. However, some spacing should be provided therebetween so that the user can seal their lips around regulator valve 22 without interference from recesses 54, and so that any spilled liquid does not accumulate on the bottom wall 58.

The regulator valve 22, the wave-breaker recess 42 and the periphery inhibitors 54 work together to break up waves of liquid and minimize spillage caused by vertical, horizontal and swirling motions of the cup. It should be noted, however, that any of these three elements alone would help prevent accidental spillage.

The lid 1 of the present invention is preferably made of plastic, using a thermal forming process, having a thickness of approximately 0.015 inch. In order to retrieve the formed lid from the thermal forming mold, all sidewall surfaces (e.g. sidewalls 14, 26, 32, 44 and 56) preferably have a 5–15 degree angle of inclination. A lid 1 according to the present invention has been constructed with annular sidewall 14 having a vertical height of 0.718 inches, where the regulator valve 22, the wave-breaker recess 42, and the periphery inhibitor recesses 54 extend down below top wall 10 by 0.25 inches, 0.656 inches, and 0.25 inches, respectively. The apertures 36/38/40 each have a diameter of 0.09 inches, and wave-breaker sidewall second portion 50 has a radius of curvature of 1.75 inches.

Figure 5A:
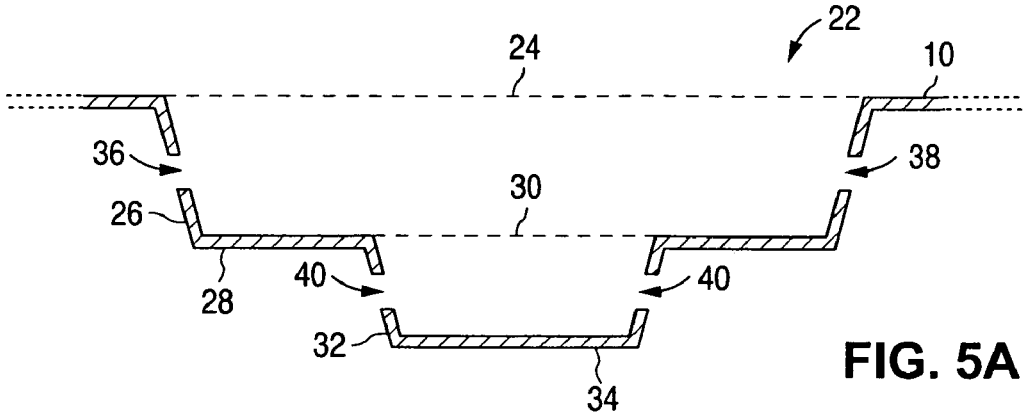
FIGS. 5A–5I are cross-sectional views of alternate embodiments of the regulator valve of the present invention.
Figure 5B:
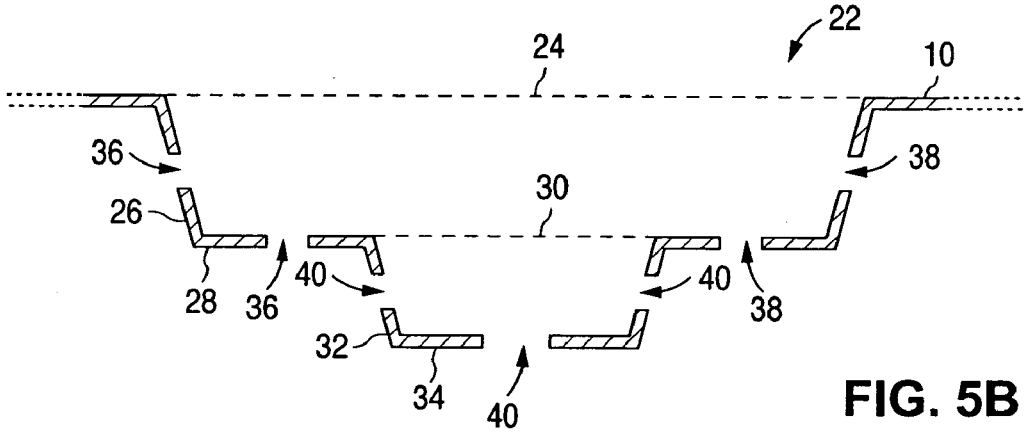
Figure 5C:
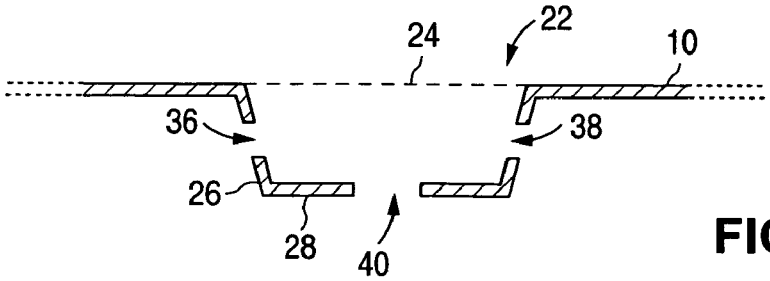
Figure 5D:
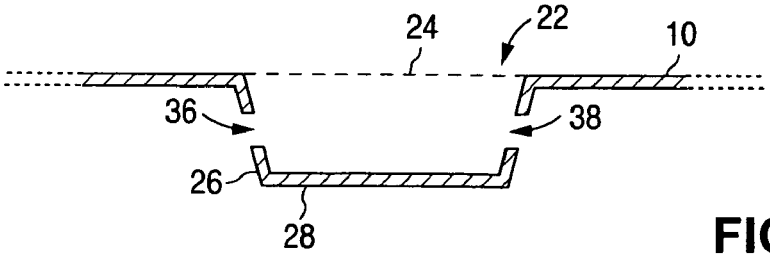
Figure 5E:
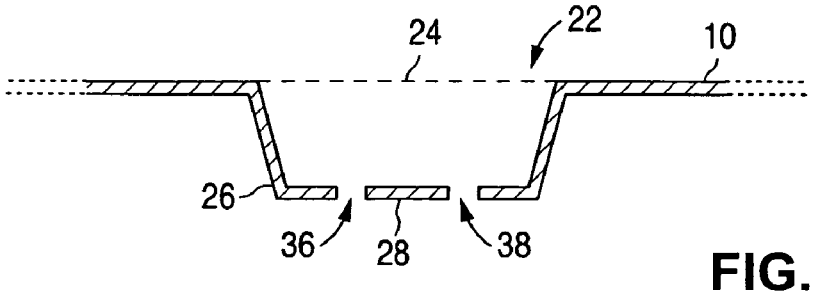
Figure 5F:
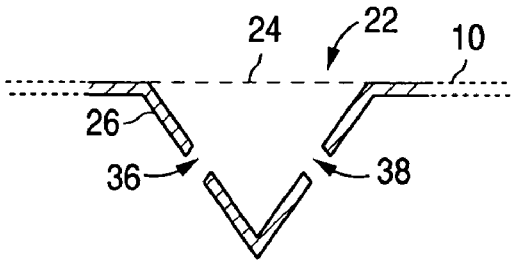
Figure 5G:
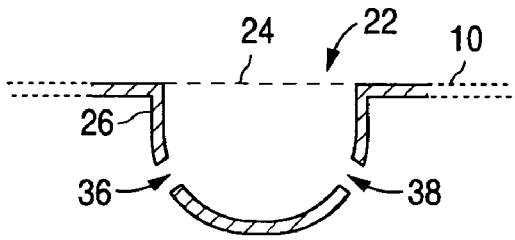
Figure 5H:
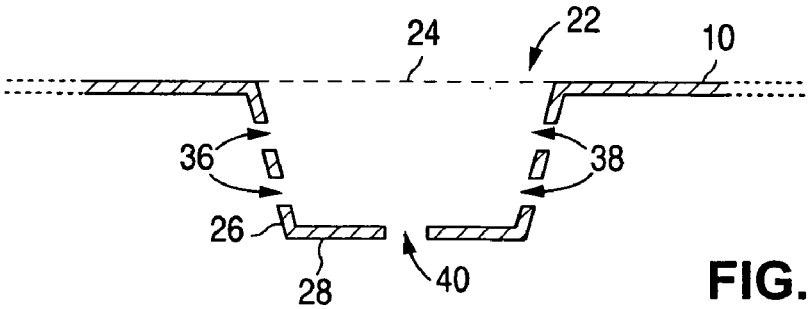
Figure 5I:
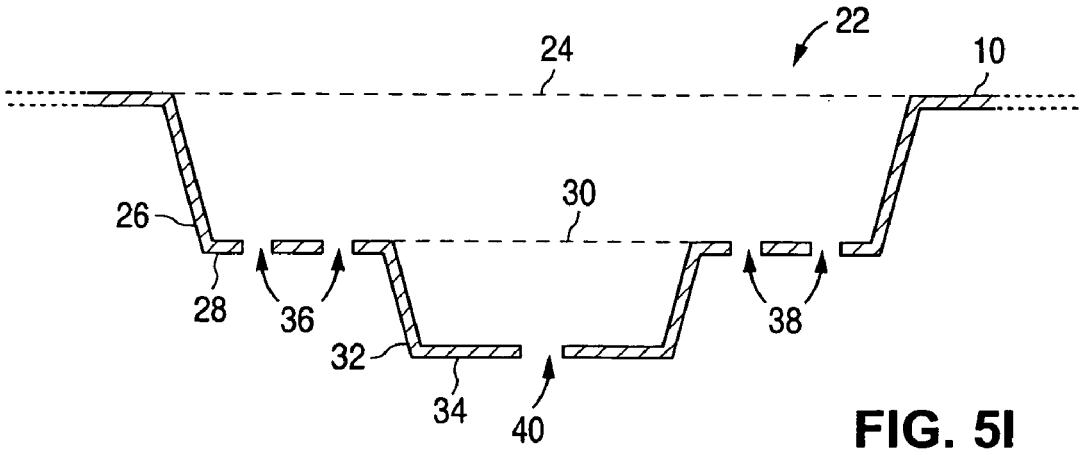
Figure 5J:
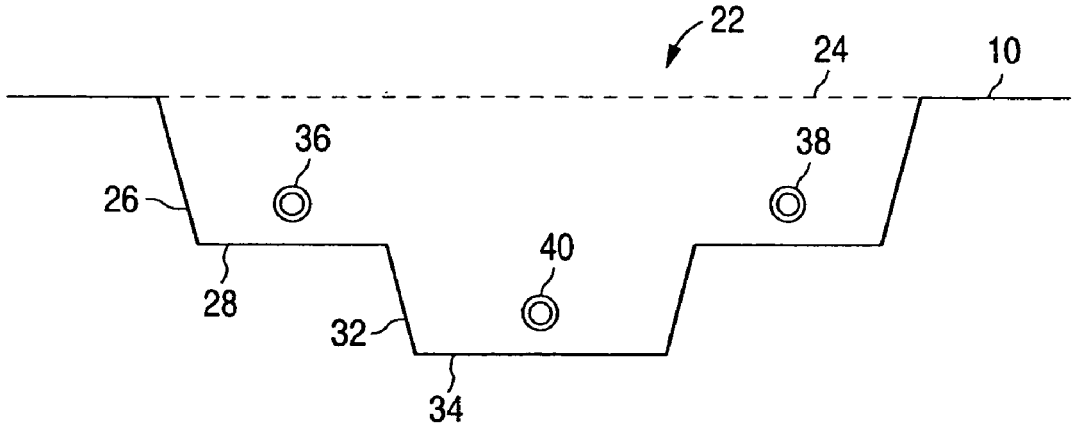
FIG. 5J is a side view of an alternate embodiment of the regulator valve of the present invention.

The apertures 36/38/40 are preferably formed in the first and second bottom walls 28/34 for ease of manufacture and because most of the wave action in beverage cups causing accidental spillage can be mainly from horizontal and swirling motions. However, apertures 36/38/40 can alternately be formed in first and second sidewalls 26/32 as shown in FIG. 5A, or both as illustrated in FIG. 5B. The second sidewall 32 and bottom wall 34 can be omitted, with the apertures formed in the first sidewall 26 and/or in the first bottom wall 28, as shown in FIGS. 5C, 5D and 5E. The first bottom wall 28 could also be omitted, with the apertures formed in the first sidewall 26 that is angled or rounded, as shown in FIGS. 5F and 5G. The number of apertures on each of the first and second sidewalls 26/32 and/or first and second bottom walls 28/34 can be varied, as shown in FIGS. 5H and 5I. Finally, the apertures formed in the sidewalls can face toward the wave-breaker recess 42 and/or the adjacent portion of annular sidewall 14, as opposed to facing along the channel 52, as illustrated in FIG. 5J. Where the apertures are formed in the sidewalls, it is preferably to form pairs of the apertures opposing one another so that any wave incident upon one aperture would not be incident upon another aperture formed on the opposing side of the sidewall. The number and locations of the apertures can vary depending upon the amount of splash protection that is desired and the ease of manufacturing, so long as a plurality of such apertures are formed in regulator valve 22 below the level of the drinking opening formed in the top wall 10.

FIGS. 4 and 5A–5J include cross-sectional views illustrating two opposing faces of sidewall 26 or sidewall 32. It should be understood that each sidewall 26 or 32 of the present invention is a three dimensional structure that encircles opening 24 or opening 30 and extends down in most cases to a bottom wall 28 or 34. Each sidewall structure 26 or 32 can be rounded or include opposing flat panel portions, and need not have the exact dimensions of the opening from which it extends.

Figure 6A:
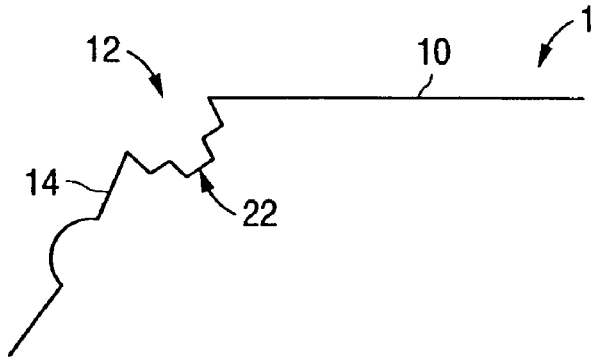
FIG. 6A is a cross-section view showing the formation of the regulator valve at the periphery of the beverage container lid of the present invention.
Figure 6B:
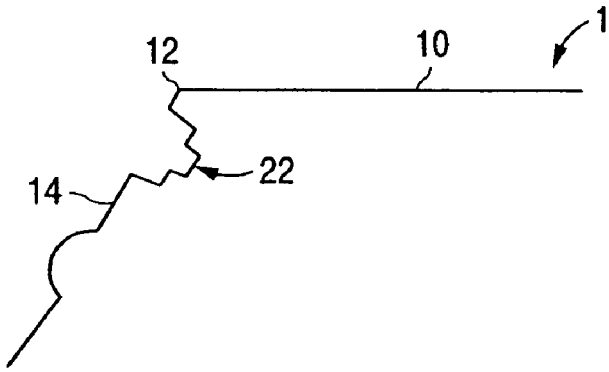
FIG. 6B is a cross-section view showing the formation of the regulator valve in the annular sidewall of the beverage container lid of the present invention.

It is to be understood that the present invention is not limited to the embodiments described above and illustrated herein, but encompasses any and all variations falling within the scope of the appended claims. For example, the regulator valve 22, the wave-breaker recess 42 and/or the inhibitor recesses 54 can extend down below the rim of the cup. Further, the regulator valve 22 can be formed at the periphery 12 as shown in FIG. 6A, or in the annular sidewall 14 as shown in FIG. 6B. Also, shaped sidewall second portion 50 of wave-breaker recess 42 can have any non-linear shape (e.g. convex shape instead of concave shape disclosed above) that helps dissipate the energy of waves incident thereon. Lastly, while the present invention is ideal for disposable lids made of thin plastic, it is certainly applicable to re-usable lids as well.

What is claimed is:

1. A lid for covering a drinking cup containing a liquid, comprising:

a top wall having a generally circular periphery;

an annular sidewall downwardly depending from the top wall periphery;

the lid including a drinking opening formed adjacent to the periphery;

a regulator valve formed under the drinking opening, the regulator valve including:

a first sidewall structure downwardly depending from the lid adjacent the drinking opening and terminating in a first bottom wall;

a plurality of apertures formed in at least one of the first sidewall structure and the first bottom wall, wherein any of the plurality of apertures formed in the first sidewall structure are positioned in an opposing manner;

a second opening formed in the first bottom wall;

a second sidewall structure downwardly depending from the first bottom wall adjacent to the second opening and terminating in a second bottom wall; and at least one aperture formed in one of the second bottom wall and the second sidewall structure.

2. The lid of claim 1, wherein the plurality of apertures are formed in the first bottom wall and the at least one aperture is formed in the second bottom wall.

3. The lid of claim 1, wherein the plurality of apertures are formed in the first bottom wall and the at least one aperture is formed in the second sidewall structure.

4. The lid of claim 1, wherein the plurality of apertures are formed in the first sidewall structure and the at least one aperture is formed in the second bottom wall.

5. The lid of claim 1, wherein each of the plurality of apertures has a size that is smaller than that of the drinking opening.

6. The lid of claim 1, wherein the drinking opening is formed in the top wall.

7. The lid of claim 1, wherein the annular sidewall includes an annular recess for receiving a rim of the cup in a liquid tight manner.

8. A lid for covering a drinking cup containing a liquid, comprising:

a top wall having a generally circular periphery;

an annular sidewall downwardly depending from the top wall periphery;

the lid including a drinking opening formed adjacent to the periphery;

a wave-breaker recess formed in the top wall having a sidewall that extends downwardly, wherein the wave-breaker recess sidewall includes a first portion facing toward the drinking opening and a second portion facing away from the drinking opening, and wherein the recess sidewall second portion is non-linear for reflecting waves of the liquid away from the drinking opening;

a regulator valve formed under the drinking opening, the regulator valve including:

a first sidewall structure downwardly depending from the lid adjacent the drinking opening and terminating in a first bottom wall;

a plurality of apertures formed in at least one of the first sidewall structure and the first bottom wall;

a second opening formed in the first bottom wall;

a second sidewall structure downwardly depending from the first bottom wall adjacent to the second opening and terminating in a second bottom wall; and at least one aperture formed in one of the second bottom wall and the second sidewall structure.

9. The lid of claim 8, wherein the plurality of apertures are formed in the first bottom wall and the at least one aperture is formed in the second bottom wall.

10. The lid of claim 8, wherein the plurality of apertures are formed in the first bottom wall and the at least one aperture is formed in the second sidewall structure.

11. The lid of claim 8, wherein the plurality of apertures are formed in the first sidewall structure and the at least one aperture is formed in the second bottom wall.

12. A lid for covering a drinking cup containing a liquid, comprising:

a top wall having a generally circular periphery;

an annular sidewall downwardly depending from the top wall periphery;

a drinking opening formed in the top wall adjacent to the periphery;

a regulator valve formed under the drinking opening, the regulator valve including:

a first sidewall structure downwardly depending from the top wall adjacent the drinking opening and terminating in a first bottom wall, a second opening formed in the first bottom wall, a second sidewall structure downwardly depending from the first bottom wall adjacent to the second opening and terminating in a second bottom wall, a plurality of apertures formed in the first bottom wall, and at least one aperture formed in the second bottom wall; and a wave-breaker recess formed in the top wall having a sidewall that extends downwardly, wherein the wave-breaker recess sidewall includes a first portion facing toward the regulator valve and a second portion facing away from the regulator valve, and wherein the recess sidewall second portion has one of a concave and a convex shape for reflecting waves of the liquid away from the regulator valve.

13. The lid of claim 12, wherein:

the wave-breaker recess sidewall first portion faces but is separated from the annular sidewall to form a channel therebetween, the regulator valve is disposed in the channel, and the lid further comprises a plurality of inhibitor recesses formed in the top wall that downwardly extend into the channel for blocking waves of the liquid traveling along the channel.

14. The lid of claim 12, wherein the wave-breaker recess extends downwardly further from the periphery than does the regulator valve.

15. A lid for covering a drinking cup containing a liquid, comprising:

a top wall having a generally circular periphery;

an annular sidewall downwardly depending from the top wall periphery;

the lid including a drinking opening formed adjacent to the periphery; and a regulator valve formed under the drinking opening, the regulator valve including:

a first sidewall structure downwardly depending from the lid adjacent the drinking opening and terminating in a first bottom wall;

a first aperture formed in the first sidewall structure or the first bottom wall;

a second opening formed in the first bottom wall;

a second sidewall structure downwardly depending from the first bottom wall adjacent to the second opening and terminating in a second bottom wall; and a second aperture formed in the second bottom wall and or second sidewall structure.

16. The lid of claim 15, wherein the first aperture is formed in the first bottom wall and the second aperture is formed in the second bottom wall.

17. The lid of claim 16, further comprising:

a third aperture formed in the first bottom wall.

18. The lid of claim 15, wherein the first aperture is formed in the first bottom wall and the second aperture is formed in the second sidewall structure.

19. The lid of claim 15, wherein the first aperture is formed in the first sidewall structure and the second aperture is formed in the second bottom wall.

20. The lid of claim 15, further comprising:

a wave-breaker recess formed in the top wall having a sidewall that extends downwardly, wherein:

the wave-breaker recess sidewall includes a first portion facing toward the regulator valve and a second portion facing away from the regulator valve, the recess sidewall second portion is non-linear for reflecting waves of the liquid away from the regulator valve, and the first sidewall structure includes a first portion facing toward a center of the top wall and toward the wave-breaker recess, and a second portion facing away from the center of the top wall and away from the wave-breaker recess.

21. The lid of claim 20, wherein the wave-breaker recess sidewall first portion faces but is separated from the annular sidewall to form a channel therebetween, and wherein the regulator valve is disposed in the channel.

22. The lid of claim 21, wherein the recess sidewall second portion has one of a convex and a concave shape.

23. The lid of claim 21, further comprising:

a plurality of inhibitor recesses formed in the top wall that downwardly extend into the channel for blocking waves of the liquid traveling along the channel.

24. The lid of claim 20, wherein the wave-breaker recess extends downwardly further from the periphery than does the regulator valve.

* * * * *